United States Patent [19]

Roche

[11] Patent Number: 4,546,828

[45] Date of Patent: Oct. 15, 1985

[54] DIVERTER SYSTEM AND BLOWOUT PREVENTER

[75] Inventor: Joseph R. Roche, Humble, Tex.

[73] Assignee: Hydril Company, Los Angeles, Calif.

[21] Appl. No.: 569,780

[22] Filed: Jan. 10, 1984

[51] Int. Cl.[4] ..... E21B 33/06

[52] U.S. Cl. ..... 166/84; 166/374; 137/869; 251/1.1

[58] Field of Search ..... 166/363, 374, 75 R, 166/369, 95, 97, 53, 84, 88; 251/1 R, 1 A, 1 B; 137/862, 865, 869, 872, 883, 885

[56] References Cited

U.S. PATENT DOCUMENTS

| | | | |
|---|---|---|---|
| 3,589,667 | 6/1971 | Lewis | 166/97 |
| 4,378,849 | 4/1983 | Wilks | 251/1 R |
| 4,444,250 | 4/1984 | Keithahn et al. | 251/1 A |
| 4,444,401 | 4/1984 | Roche et al. | 166/363 |
| 4,456,062 | 6/1984 | Roche et al. | 137/869 |
| 4,456,063 | 6/1984 | Roche | 166/84 |

*Primary Examiner*—Stephen J. Novosad
*Assistant Examiner*—Bruce M. Kisliuk
*Attorney, Agent, or Firm*—Dodge, Bush & Moseley

[57] ABSTRACT

A system is disclosed which may alternatively be used as a diverter or as a blowout preventer for a drilling rig. The system comprises a BOP attached above a spool having a hydraulically driven sleeve/piston. An outlet passage in the spool, which may be connected to a vent line, is closed off by the sleeve wall when the spool piston is at rest.

Hydraulic ports are connected above and below the BOP annular piston and above and below the spool annular piston. The ports below the BOP piston and above the spool piston are in fluid communication with each other. A hydraulic circuit is provided having two valves between a source and a drain of pressurized hydraulic fluid.

6 Claims, 3 Drawing Figures

DIVERTER SYSTEM AND BLOWOUT PREVENTER

BACKGROUND OF THE INVENTION

1. Field of the Invention

This invention relates in general to diverters and blowout preventer systems for drilling rigs. In particular, the invention relates to a system adapted for alternative use as a diverter or a blowout preventer.

2. Description of the Prior Art

Diverter systems are known for offshore drilling rigs in which a diverter element is provided in the support housing attached to the support beams beneath the drilling rig rotary table. Such diverter systems have provided a vent line and a flow line in the permanent housing beneath the rotary table. Such systems have required external valve systems in the vent line to open the fluid system to the vent line when the diverter is closed so that fluid flow may be directed away from the drilling rig. Such diverter systems have been provided not only for floating vessel drilling rigs, but also for bottom supported offshore drilling rigs.

Fatal and costly accidents have resulted from the complexity of the prior art diverter systems described above. Typical prior art diverter systems have included an annulus closing device, external vent and flow line valves, actuators, limit switches and sequence controls. This complicated valving and piping of the prior art has been further complicated by the inherent risks of manipulating loose packer inserts into the diverter itself. The complexity of the prior art systems has invited a variety of human error and equipment malfunctions.

One problem with the prior art systems has involved the use of external valving in the diverter system. Valves which are external to the diverter unit not only add clutter to the diverter system and the rig configuration, they have also required multiple control functions which are required to operate correctly. For example, prior art diverter system valves have required an actuating pressure signal that is regulated to a discrete pressure level different from the operating pressure level of the diverter unit. The need for separate and different control functions executed in only one safe sequence has required separate pressure regulators and connecting functional components that are in different locations on the underside of the rig floor. Such a requirement has invited mistakes and malfunctions.

In addition to the problem of multiple control functions, there has existed problems with mistakenly crossed hydraulic connections in prior art diverter systems. Misconnection of control lines can cause a valve to be closed when it should be open or vice versa potentially resulting in an explosion in the diverter system or breach of the casing.

Another problem of the prior art diverter systems has been exposure to the working environment of delicate parts such as hydraulic tubing and fittings, limit switches, mechanical linkages and valve actuators. Such exposure has in the past caused occasional breakage and damage to such parts. Delicate parts can be damaged or broken by impact with heavy equipment, use as steps or handholds by working personnel, or vibrations induced by running equipment. System malfunctions which result from such damage can be catastrophic.

Another hazard of prior art diverter systems has been the result of vent line blockage because the vent valve has been remote from the diverter unit itself. A stagnant space has existed at a critical location in the vent line. Build up of ice or other solids and/or caking of mud in such a dead space may cause the critically important vent line to be choked off. A restricted or shut-off vent line may cause a dangerous pressure increase while being called upon to divert.

Still another problem of prior art diverter systems has involved the use of component sources from a number of different manufacturers. The annulus closing device, vent and flow line valves, actuators, sequencing devices and control system components have typically each been provided by a different manufacturer. Rig operating personnel are usually burdened with devising the vent line valve circuit interconnecting the components (which are often widely physically separated when installed) and stocking a varied assortment of spare parts using extraordinary caution to avoid misconnections and keeping a number of rig personnel trained to operate and maintain a diverse assortment of complicated components.

One prior art diverter system for bottom supported rigs has included the use of a high pressure external valve in the vent line to control the diverting function. Closure of such a valve has enabled the diverter to be converted to a blowout preventer after sufficient casing pressure integrity has been established during drilling operations. However, if this valve should inadvertently be closed during an attempt to divert, breach of the casing or explosion of the diverter system could threaten the safety of the rig itself.

Still another problem of prior art diverter systems has been the result of valve mismatch. While many different types of valves have been used in diverter systems, there has been no single valve that has been designed expressly for or is especially well suited to the particular application of a diverter system. Selection of the type, size and rating of such valves has been a vexing puzzle for designers of rig valve systems which has been required to solve usually when a new drilling rig is being built.

Another disadvantage of some prior art diverter systems has been the necessity to stop drilling operations and manipulate packer inserts to facilitate annulus shut-off. Packer inserts, concentric with the standard large bore packer are essential in closing the annulus around the pipe because the design of the large bore packer is relatively crude, not facilitating displacement of the packer material to move into and shut-off the annulus and pack-off against the pipe. Such packer inserts are required for example in the KFDJ platform diverter system which is a product of the Hughes Offshore Company. The necessity to stop drilling operations and manipulate packer inserts has not only been a time consuming task, it has presented very real hazards. One such hazard has been the problem of forgotten inserts. Often in the course of determined efforts to drill ahead, fetching, installing and latching the packer insert is overlooked. Without such an insert there is no diverter protection. If the insert is in place, but not latched down in such prior art diverter systems, the packer insert is potentially a dangerous projectile.

A second problem resulting from the use of packer inserts has been the problem of hazard when there is no pipe in the hole. The insert cannot effect a pressure containing closure on an open bore. There has been no protection from the insert type diverter against uncontrolled well fluid flows when no pipe is in the bore. Such lack of protection has left a serious safety gap in the drilling operation.

Still another problem with the use of packer inserts in the prior art diverter systems has been the problem of forgotten insert removal. If unlatch and removal of the packer insert has been inadvertently overlooked before pulling drill pipe from the hole, centralizers or the bottom hole assembly may be run into the insert thereby endangering the drilling crew and equipment.

Still another problem of packer inserts has been sticking latches. Mud, ice, or other buildup can cause the latch mechanism to sieze, so that hydraulic pressure does not effect a proper latch. If the insert is not properly held in place by the latch, the safety of the diverter unit is negated.

Still another problem of the use of packer inserts in some prior art drilling systems has been the problem of rupturing packers. If during testing, the standard packer is inadvertently not reinforced by an insert and/or a pipe in the hole, the hydraulic fluid pressure may cause the packer to violently rupture, thus jeopardizing the safety of the crew.

Perhaps the most destructure problem of the prior art diverter systems has been the inherent risk of pressure testing in situ. Pressure testing of prior diverter systems has been accomplished by overriding the safety sequencing in the valves so that the vent line valve is closed simultaneously with closure of the annulus. Such problem is inherent not only in the packer insert type diverter systems, but also the annular blowout preventer/spool type diverter systems. Disastrous results have been experienced when the safety overriding mechanism has been unintentionally left in place when testing is completed and drilling is resumed.

IDENTIFICATION OF THE OBJECTS OF THE INVENTION

It is therefore a primary object of this invention to overcome the disadvantages and problems and inherent safety risks of the prior art diverter systems.

It is another object of the invention to provide a system which may be remotely controlled for alternative use as a diverter system or as a blowout preventer system.

It is another object of the invention to provide a system designed for alternative use as a diverter system or annular blowout preventer system in which in the diverter mode, the opening of a vent line occurs sequentially before the closing of the annulus by the diverter.

It is still another object of the invention to provide a hydraulic control system for the operation of the system adapted for alternative use a diverter or a blowout preventer system. In other words, it is an object to provide via remote hydraulic controls a hydraulic signal to the unit for performing an inherently safe execution of the rerouting of flow of a well kick or, after deliberate reconfiguration of the system, for closing in the well in a blowout preventer mode.

It is another object of the invention to provide a rugged and protected system, one in which no external valves are in the vent line path which may be closed when the diverter is closed thereby causing dangerous pressure buildup.

It is another object of the invention to provide a system having no stagnant space, a system in which the vent flow is immediately opened when the system is operating in a diverter mode and begins to divert flow away from the work area. Avoiding the stagnant space eliminates a place for caking of solids that may obstruct or shut-off vent flow.

It is still another object of the invention to provide an annular packing unit in a system adapted for alternative use as a diverter system or annular blowout preventer system thereby affording many important safety and operational advantages. It is another object of the invention to employ an annular packer that can close and seal the annulus around pipe without need for packer inserts. Avoidance of providing inserts eliminates potentially fatal mistakes such as forgetting to fetch, install and latch down the inserts. Such advantage also includes the effect of rig time saved.

Another important advantage of the system adapted for alternative use as a blowout preventer system or a diverter system according to the invention is to provide a blowout preventer system packing unit which can close and seal on open bore thus providing ready assurance of safety in the event of excessive well flow while there is no pipe in the hole and eliminating a serious gap in the safety of the drilling operation of using diverter inserts or some prior art diverter systems.

Another important advantage of the invention is to provide for safe testing of a system adapted for alternative use as a diverter or blowout preventer unit having a packing unit which does not directly contact hydraulic fluid during actuation thereby eliminating the dangers of violently rupturing packers.

SUMMARY OF THE INVENTION

According to the invention, a system is provided achieving the above identified objects as well as other advantages and features for use with drilling rigs, especially offshore drilling rigs, which is adapted for alternative use as a diverter or a blowout preventer, especially during the initial drilling phases of a borehole. The system comprises a blowout preventer having a resilient packing means and having a closing port and an opening port by which connection of a source of pressurized hydraulic fluid to the closing port closes the hydraulic preventer and connection of a source of pressurized hydraulic control fluid to the opening port opens the blowout preventer. A spool means is provided in series with and below the blowout preventer. The spool means has a housing with a vent outlet passage provided in its wall.

A diverter piston having an annular wall is disposed within the housing. A lower port in the housing is provided by which connection of a source of pressurized hydraulic control fluid to the lower port raises the piston from a lower position to an upper position and an upper port by which connection of a source of pressurized hydraulic control fluid to the upper port lowers said piston from an upper position to a lower position in the housing.

The vent outlet passage in the housing wall is covered by the annular wall of the piston means when it is in the lower position. The vent outlet passage is open to the interior of the housing when the piston is in the upper position. Hydraulic circuit means is provided for connecting a source of pressurized hydraulic control fluid to the closing port of the blowout preventer thereby closing the blowout preventer while insuring that the outlet passage in the diverter housing remains covered by the diverter piston wall. The hydraulic circuit means is also provided for alternately connecting a source of pressurized hydraulic control fluid to the lower port in the diverter housing thereby raising the diverter piston from its lower position and uncovering the vent outlet in the spool wall and sequentially closing the blowout preventer.

Preferably, the blowout preventer of the novel system is an annular blowout preventer adapted for closing the annulus between a drill pipe or other object and the interior vertical bore of the preventer or completely closing and sealing the vertical bore of the preventer in the absence of any object in the preventer.

A vent line is preferably connected to the vent outlet passage provided in the housing wall of the spool to conduct pressurized well fluid away from the drilling rig on the occurrence of a kick.

According to the invention, the hydraulic circuit means comprises a first hydraulic two position valve having an open position and a close position and a second hydraulic two position valve having a BOP position and a divert position. Hydraulic lines are connected respectively between the opening port of the BOP and the first hydraulic valve, between the first and second hydraulic valves, between the second hydraulic valve and the lower port of the housing of the diverter means, and among the upper port of the housing of the spool means and the closing port of the blowout preventer and the second hydraulic valve.

A closed and sealed reservoir of hydraulic fluid is disposed in the diverter housing above the diverter piston when the piston is in the lower position. When the first hydraulic valve is in the open position, a source of pressurized hydraulic control fluid is applied to the open port of the BOP thereby opening the BOP and maintaining the diverter position in its lower position.

When the first hydraulic valve is in the closed position and the second hydraulic valve is in the divert position, the source of hydraulic fluid is applied to the lower port of the spool means thereby raising the diverter piston from a lower position to an upper position, uncovering the outlet passage in the housing, forcing the reservoir of hydraulic fluid above the diverter piston to the closing port of the BOP via the hydraulic line between the upper port of the housing of the spool means and the closing port of the BOP thereby sequentially closing the BOP after the outlet passage in the diverter housing is opened.

When the first hydraulic valve is in the closed position and the second hydraulic valve is in the BOP position, the source of hydraulic fluid is applied to the closing port of the BOP and the upper port of the spool means thereby closing the BOP and maintaining the diverter piston in its lower position.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is presented of which.

DESCRIPTION OF THE INVENTION

Figure 1:
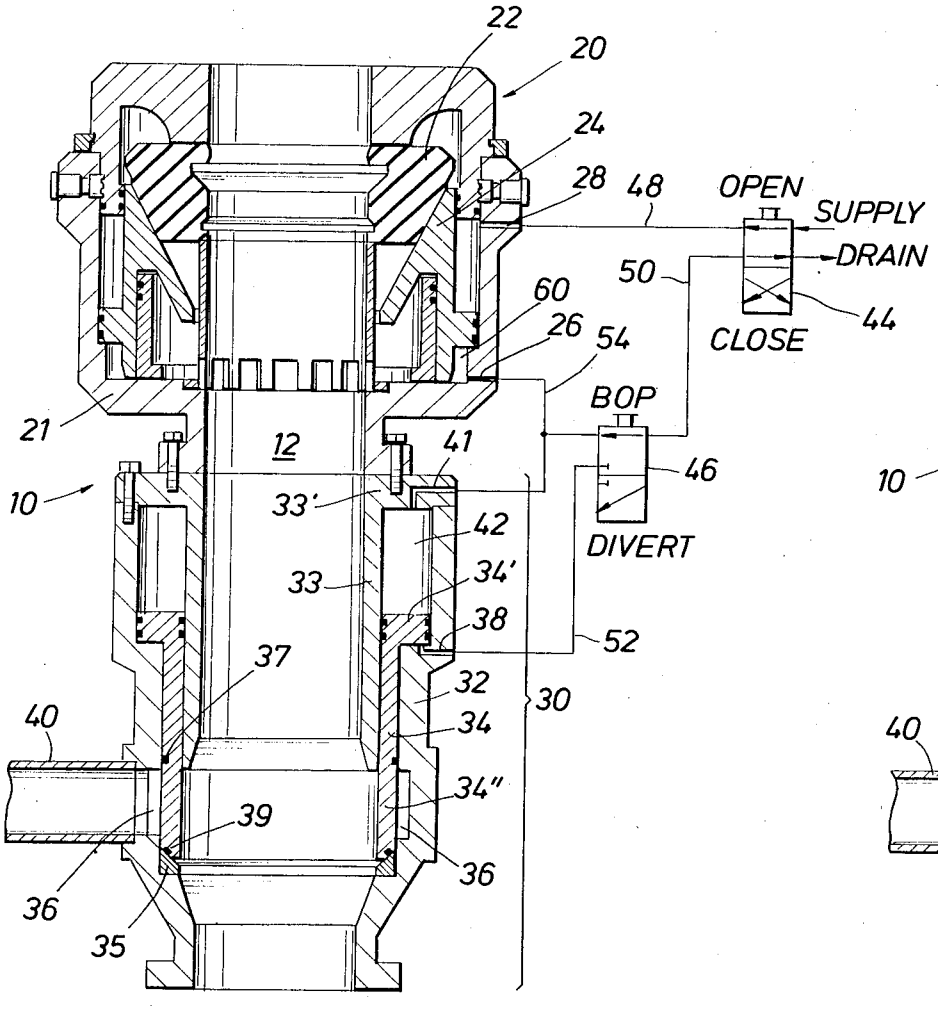
FIG. 1 illustrates the system, according to the invention, of an annular blowout preventer connected in series above a spool having a diverter annular piston and opening in the spool housing and a hydraulic circuit for alternatively connecting the system as a diverter or a BOP. The system of FIG. 1 shows the system having an opened vertical flow path.

FIG. 1 shows a system 10 adapted for alternative use as a diverter or a blowout preventer for use with a drilling rig. Such system may find application especially in offshore drilling rigs. Although the system could find application is a floating drilling rig or even a land rig, its preferred application would be for bottom founded offshore drilling rigs.

According to the invention, a blowout preventer 20 is connected in series above a diverter spool 30. Although illustrated schematically as two separate units, the diverter spool housing 32 could be integral with the BOP housing 21. Alternatively, the diverter spool 30 could be separated vertically from the housing 21 of the BOP 20 by providing an intermediate spool between the two housings. Such a configuration would be adapted to the spatial arrangement necessities of, for example, an offshore drilling platform or bottom founded offshore drilling rig.

According to the invention, the BOP 20 is preferably an annular type BOP having an annular packing unit 22, an annular piston 24, an opening port 28 and a closing port 26. Such an annular blowout preventer (BOP) is well known in the art and functions to close and seal the packing unit about an object in the vertical flow path 12 or to completely close and seal the bore 12 in the absence of an object. The BOP functions to close about the vertical flow path when a source of pressurized hydraulic control fluid is applied to the closing port 26 or alternatively to open when a source of pressurized hydraulic control fluid is applied to the opening port 28.

As illustrated in FIG. 1, the opening port is connected to a source of pressurized hydraulic control fluid and the annular piston 24 is forced downwardly causing the packer unit 22 to open in the usual fashion.

According to the invention, the diverter spool 30 has a spool housing 32 in which is disposed a spool annular piston 34. A cylindrical member 33 is also disposed in the spool housing 32 defining an annular space between the spool housing 32 and the cylindrical member 33 in which the spool annular piston 34 is disposed. As illustrated in FIG. 1, the spool annular piston 34 is in a lower position. In such lower position, a reservoir space 42 is provided between the head of the piston 34' and the uppermost portion 33' of sleeve member 33. The reservoir space 42 is preferably filled with hydraulic fluid.

An outlet passage 36 is provided in the lower part of the spool housing 32, and when the spool annular piston 34 is in the lower position, as illustrated in FIG. 1, the lower part 34'' of the spool piston 34 covers and seals the outlet passage 36. A vent line 40 is connected to the spool housing 32 for communication with the outlet passage 36. In the lower position of the spool piston 34, the outlet passage 36 is closed from communication within the vertical flow path 12 of the system to the vent line 40. Seals 37 and 39 serve to seal fluid from the vertical flow path 12 to the outlet passage 36 and vent line 40 when the spool annular piston 34 is in the lower position. In the preferred embodiment of the invention, a "sacrificial" ring 35 is provided below the bottom with seal 39 in sealing the outlet passage 36 from the vertical flow path. The ring 35 may be easily replaced if it should erode during the divert mode of the system 10.

According to the invention, lower port 38 is provided for directing a source of pressurized hydraulic fluid beneath the upper part 34' of spool annular piston 34 for the purpose of raising spool annular piston 34 within the spool housing 32. An upper port 41 is provided for lowering the spool piston 34 within the spool housing 32 when a source of pressurized hydraulic fluid is applied to the upper port 41.

According to the invention, a hydraulic circuit is provided for alternatively connecting the system as a diverter or as a blowout preventer. The hydraulic circuit comprises a first hydraulic valve 44 and a second hydraulic valve 46. A hydraulic line 48 is provided between the opening port 28 of the BOP and the first hydraulic valve 44. The hydraulic line 52 is provided between the lower port 38 and the second hydraulic valve 46. Another hydraulic line 50 is provided between the first hydraulic valve 44 and the second hydraulic valve 46. A hydraulic line 54 is provided between the closing port 26 of BOP 20 and the upper port 40 of the diverter spool 30. (Where housing 21 of the BOP and housing 32 of the spool 30 are integral, line 54 may be provided within the combined integral housing). Hydraulic line 54' connects the second hydraulic valve 46 to the line 54 between the closing port 26 of BOP 20 and the upper port 40 of the diverter spool 30.

In the positions illustrated of the first hydraulic valve 44 and the second hydraulic valve 46, a hydraulic path exists from a supply of pressurized hydraulic fluid through the first hydraulic valve 44 to the opening port 28 of BOP 20. Providing a source of pressurized hydraulic control fluid via the opening port 28 causes the annular piston 24 to remain in the lower position thereby maintaining the packing unit 22 in the relaxed or open state. The fact that the annular piston 24 is in the lower position causes any hydraulic fluid in space 60 beneath the annular piston 24 to be forced downwardly and simultaneously via the output to the drain of the hydraulic fluid via line 54 and line 54' through the second hydraulic valve 46 and hydraulic line 50. The spool piston 34 remains in its lower position. In the position of the first and second hydraulic valves 44 and 46, as illustrated in FIG. 1, the spool piston 34 remains in its lower position, operably closing off flow from the upward vertical flow path 12 to the vent line 40, and the annular BOP 20 remains in an open position.

Figure 2:
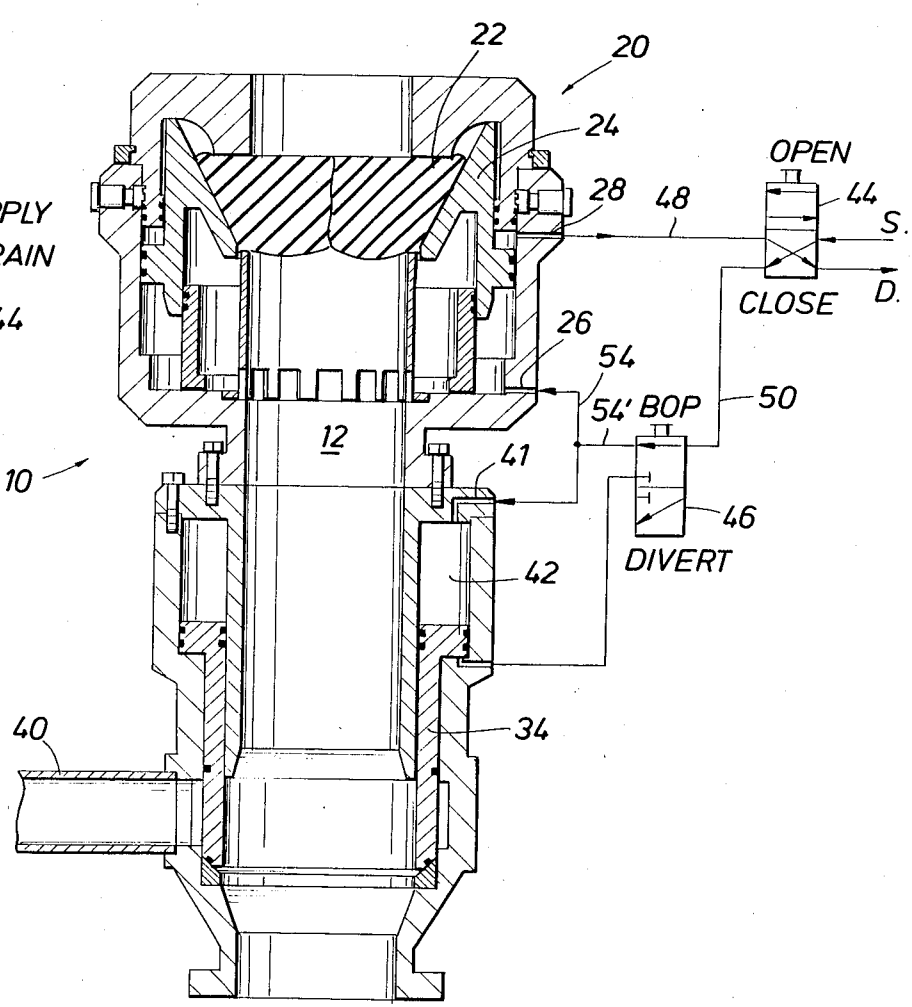
FIG. 2 shows the system, according to the invention, in which a hydraulic circuit controls the apparatus in a blowout preventer mode. The system is illustrated where the annular packing unit of an annular BOP completely closes off and seals the vertical flow path where no object such as a drill pipe, etc. is in the vertical flow path.

FIG. 2 illustrates the condition of the system after the hydraulic circuitry has been configured to put the system into a blowout preventer pressure containment mode. The second hydraulic valve 46 is shown remaining in the BOP position while the first hydraulic valve 44 has been moved to the "close" position.

In the closed position of the hydraulic valve 44, the source of pressurized hydraulic control fluid is directed via hydraulic line 50 and second hydraulic valve 46 to line 54' and line 54 to the closing port 26 of BOP 20. Providing a source of pressurized hydraulic fluid beneath the piston 24 causes it to move upwardly operably directing the annular packing unit 22 radially inwardly until it completely closes off the vertical flow path 12. By applying the source of pressurized hydraulic fluid to line 54' and line 54, the source of pressurized hydraulic fluid is also applied to the upper port 41 operably retaining the spool piston 34 in its lower position and operably preventing fluid communication between vent line 40 and the vertical flow path 12.

Figure 3:
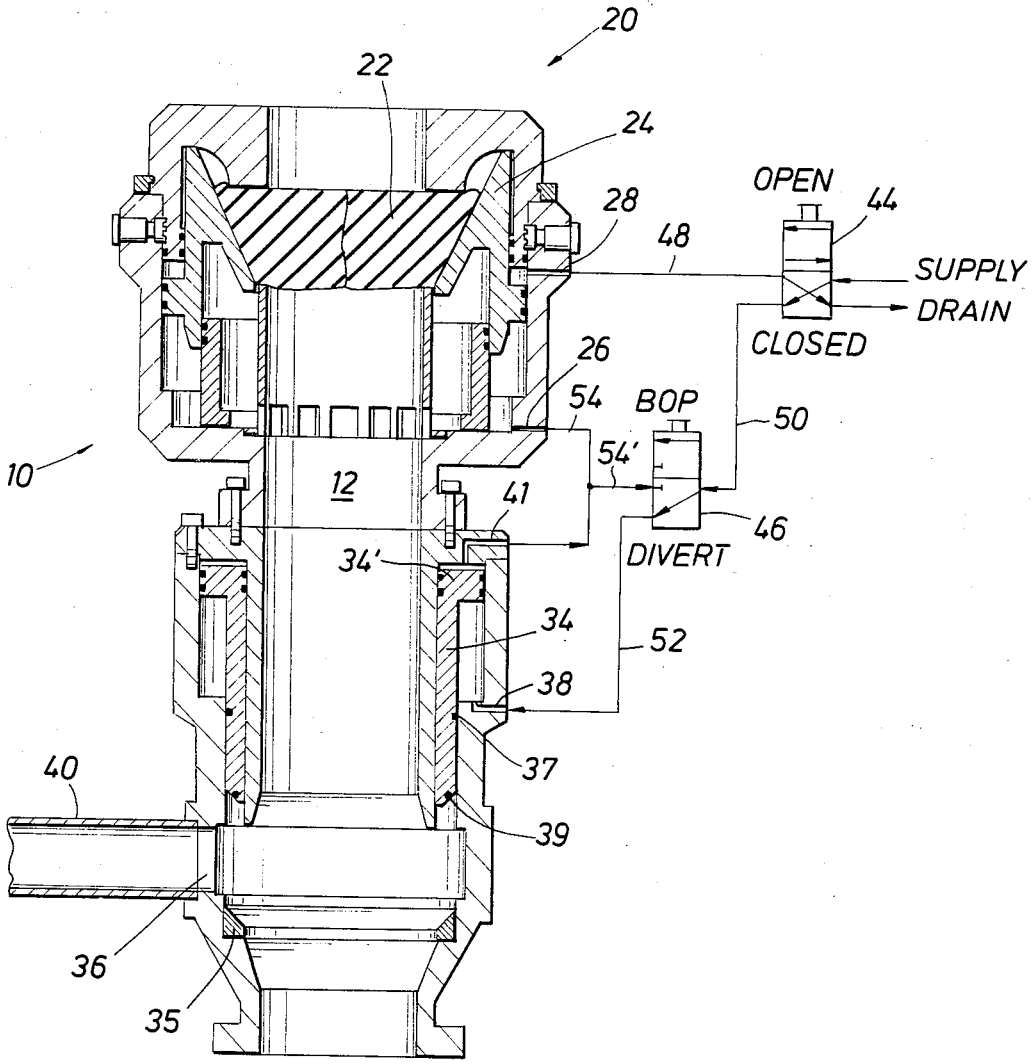
FIG. 3 shows the system, according to the invention, in which the hydraulic circuit controls the system to be connected as a diverter in which an opening to a vent line is provided and the vertical flow path is sequentially closed and sealed by the BOP unit.

FIG. 3 illustrates the system, according to the invention, after it has been put into the divert mode. FIG. 3 should be viewed as the end result of providing first hydraulic valve 44 to the closed position after the second hydraulic valve 46 has been moved to the divert position. In other words, FIG. 3 should be viewed as coming to the condition as illustrated from that illustrated in FIG. 1. In still other words, the second hydraulic valve 46 is first put to the divert position and then the first hydraulic valve 44 is moved to the closed position.

Before first hydraulic valve 44 is moved to the closed position, the vertical flow path 12 will be completely open. That is, the spool piston 34 will be in the lower position as illustrated in FIG. 1 and the annular piston 24 and the packing unit 22 will be in the relaxed or open position. When the first hydraulic valve 44 is moved to the closed position, the supply of pressurized hydraulic control fluid is applied via the first hydraulic valve 44, the hydraulic line 50 and the second hydraulic valve 46 to the hydraulic line 52 to the lower port 38. Application of a pressurized hydraulic control fluid beneath the upper part 34' of the spool piston 34 causes the piston to move upwardly to an upper position as illustrated in FIG. 3. Upward movement of spool annular piston 34 opens the outlet passage 36 allowing fluid communication from the vertical flow path 12 to vent line 40.

The upward movement of the spool piston 34 causes the reservoir of hydraulic fluid 42, as illustrated in FIG. 1, to move upwardly via the upper port 41 and line 54 to the closing port 26 of BOP 20. Application of the pressurized fluid from the reservoir 42 beneath the piston 24 causes it to move upardly and thereby closing the annular packing unit 22 about an object in the vertical flow path 12 or completely closing the vertical flow 12 even in the absence of any object in the well bore.

It should be observed that the annular piston 24 does not move upwardly until the spool piston 34 has moved upwardly sufficiently to open the outlet 36 to fluid communication with the vent line 40. Thus, the annular packing unit 22 sequentially closes after the opening 36 has been uncovered. This sequential opening of the diverter spool opening 36 and the closing of the annular BOP 20 insures that the system when in the divert mode can never be completely closed off in the event of a kick or other emergency.

The system 10 is returned to the open position by returning the first hydraulic valve 44 to the open position. As FIG. 1 illustrates, the supply of pressurized hydraulic control fluid is applied via line 48 to opening port 28 operably driving the annular piston 24 downwardly and forcing hydraulic fluid in the annular space out the closing port 26 to the upper port 41 and driving the spool piston 34 downwardly to the lower position. Thus, as illustrated in FIG. 1, the system is returned to the open position of having the upward fluid flow path 12 completely open for normal drilling operations with the outlet passage 36 closed off by the lower portion 34'' of spool piston 34.

Various modifications and alterations in the described structures will be apparent to those skilled in the art of the foregoing description which does not depart from the spirit of the invention. For this reason, these changes are desired to be included in the appended claims. The claims which follow recite the only limitation to the present invention and the descriptive manner which is employed for setting for the embodiments and is to be interpreted as illustrative and not limitative.

What is claimed is:

1. A system adapted for alternative use as a blowout preventer or a diverter, comprising a blowout preventer having a resilient packing means and having a closing port and an opening port by which connection of a source of pressurized hydraulic control fluid to the closing port closes the blowout preventer and connection of a source of pressurized hydraulic fluid to the opening port opens the blowout preventer, a spool means disposed in series with and below the blowout preventer, the spool means having a housing having an outlet passage provided in its wall, a diverter piston having an annular wall and disposed within the housing, a lower control port in said housing by which connection of a source of pressurized hydraulic fluid to the lower port raises said piston from a lower position to an upper position and an upper control port by which connection of a source of pressurized hydraulic fluid to the upper port lowers said piston from an upper position to a lower position in said housing, said outlet passage in said housing wall being closed off by the annular wall of the piston means when in said lower position and being open to the interior of the housing when in said upper position, and hydraulic circuit means for connecting a source of pressurized hydraulic control fluid to said closing port of said blowout preventer thereby closing said blowout preventer while insuring that the outlet passage in said diverter housing remains closed off by said diverter piston wall, or for connecting a source of pressurized hydraulic control fluid to said lower port in said diverter housing thereby raising said diverter piston from its lower position and opening said outlet passage and sequentially closing said blowout preventer.

2. The system of claim 1 wherein said blowout preventer is an annular blowout preventer adapted for closing the annulus between a drill pipe or other object and the interior vertical bore of the preventer or completely closing the vertical bore of the preventer in the absence of any object in the preventer.

3. The system of claim 1 further comprising a vent line connected to the outlet passage provided in the housing wall of the diverter means.

4. The system of claim 1 wherein said hydraulic circuit means comprises, a first hydraulic valve having an open position and a closed position, a second hydraulic valve having a BOP position and a divert position, hydraulic lines connected respectively between the opening port of the BOP and the first hydraulic valve between the first and second hydraulic valves, between the second hydraulic valve and the lower port of the housing of the diverter means, and among the upper port of the housing of the spool means and the closing port of the blowout preventer and the second hydraulic valve, and a reservoir of hydraulic control fluid disposed in the diverter housing above the diverter piston when the piston is in the lower position, whereby when the first hydraulic valve is in the open position, a source of pressurized hydraulic control fluid is applied to the opening port of the BOP thereby opening the BOP and maintaining the diverter piston in its lower postion, when the first hydraulic valve is in the closed postion and the second hydraulic valve is in the BOP position, a source of hydraulic fluid is applied to the closing port of the BOP and the upper port of the spool means thereby closing the BOP and maintaining the diverter piston in its lower position, and when the first hydraulic valve is in the closed position and the second hydraulic valve is in the divert position, a source of pressurized hydraulic fluid is applied to the lower port of the spool means operably raising the diverter piston from a lower position to an upper position, opening said outlet passage in said housing, forcing the reservoir of hydraulic fluid above the diverter piston to the closing port of the BOP via the hydraulic line between the upper port of the housing of the spool means and the closing port of the BOP and operably sequentially closing the BOP after the outlet passage in the diverter housing is opened.

5. The system of claim 1 further comprising means for sealing the outlet passage in the housing of the spool means from fluid communication with the interior of the housing when the diverter piston is in the lower position.

6. The system of claim 5 wherein the sealing means comprises a sacrificial ring disposed about the interior of the spool means housing below the outlet passage in the wall of the housing and an elastomeric ring operably disposed in the bottom end of the annular wall of the diverter piston for sealing engaging the sacrificial ring when the diverter piston is in the lower position.

* * * * *